United States Patent [19]

DeVigili

[11] Patent Number: 4,690,423

[45] Date of Patent: Sep. 1, 1987

[54] SKI BRAKING DEVICE

[76] Inventor: Walter J. DeVigili, 4215 Brown Rd., Emmett, Mich. 48022

[21] Appl. No.: 846,611

[22] Filed: Mar. 31, 1986

[51] Int. Cl.[4] ..... A63C 7/10

[52] U.S. Cl. ..... 280/605

[58] Field of Search ..... 280/605, 604, 601; 188/5, 8

[56] References Cited

U.S. PATENT DOCUMENTS

| | | | |
|---|---|---|---|
| 4,108,465 | 8/1978 | Schmidt | 280/605 |
| 4,398,746 | 8/1983 | Heintz | 280/604 |

FOREIGN PATENT DOCUMENTS

| | | | |
|---|---|---|---|
| 2482464 | 11/1981 | France | 280/605 |
| 2486407 | 1/1982 | France | 280/605 |
| 71551 | 1/1947 | Norway | 280/605 |
| 116966 | 8/1946 | Sweden | 280/605 |
| 133498 | 8/1929 | Switzerland | 280/605 |
| 187456 | 2/1937 | Switzerland | 280/605 |

*Primary Examiner*—David M. Mitchell

*Attorney, Agent, or Firm*—Barnes, Kisselle, Raisch, Choate, Whittemore & Hulbert

[57] ABSTRACT

A braking device is disclosed for reducing or retarding rearward movement of a ski, such as when climbing a hill. The device comprises an elongated frame mounted lengthwise in a recess in the bottom of a ski. A plurality of cleats are spaced apart lengthwise of the frame. The front ends of the cleats are pivoted to the frame for vertical movement. The cleats pivot downwardly and dig into the snow when the ski moves rearwardly, acting as a brake. The cleats pivot upwardly and become inoperative during normal downhill skiing. The braking device may be used for all skis, but is primarily intended for cross-country and touring downhill skis. It is preferably built into the ski by the ski manufacturer as original equipment, but may be added to an existing ski.

3 Claims, 4 Drawing Figures

SKI BRAKING DEVICE

This invention relates to a braking device for a ski adapted to reduce or retard rearward movement of the ski, such as when climbing a hill. The braking device may be used for all skis, but is primarily intended for cross-country and touring downhill skis. The braking device is preferably built into the ski as original equipment, although an existing ski may be modified to incorporate the device.

SUMMARY OF THE INVENTION

A primary object of this invention is to provide a braking device for a ski designed especially for use by beginning skiers but of general use for all. One or more braking devices are provided for each ski. Each braking device comprises an elongated frame adapted to be mounted lengthwise in a recess in the bottom of the ski. A braking device is preferably placed near the ski boot binding. A plurality of cleats are spaced apart lengthwise of the frame and pivoted at the front ends for vertical movement. The cleats are capable of pivoting from a lower operative position projecting below the bottom of the ski to an upper retracted position. In the lower position, the cleats will dig into the snow when climbing a hill to reduce or retard rearward movement. In their upper position the cleats are flush with or close to being flush with the bottom surface of the ski so as not to interfere with normal down hill skiing.

Other objects and features of the invention will become more apparent as the following description proceeds especially when considered with the accompanying drawings.

DETAILED DESCRIPTION

Figure 1:
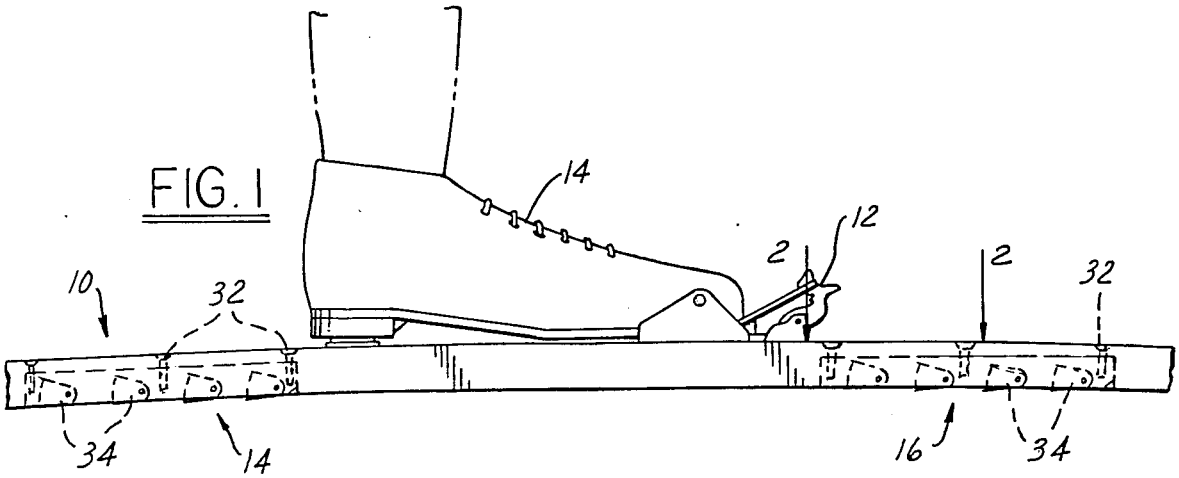
FIG. 1 is a fragmentary side elevational view showing the mid-portion of a ski with two of the braking devices of my invention incorporated therein.
Figure 2:
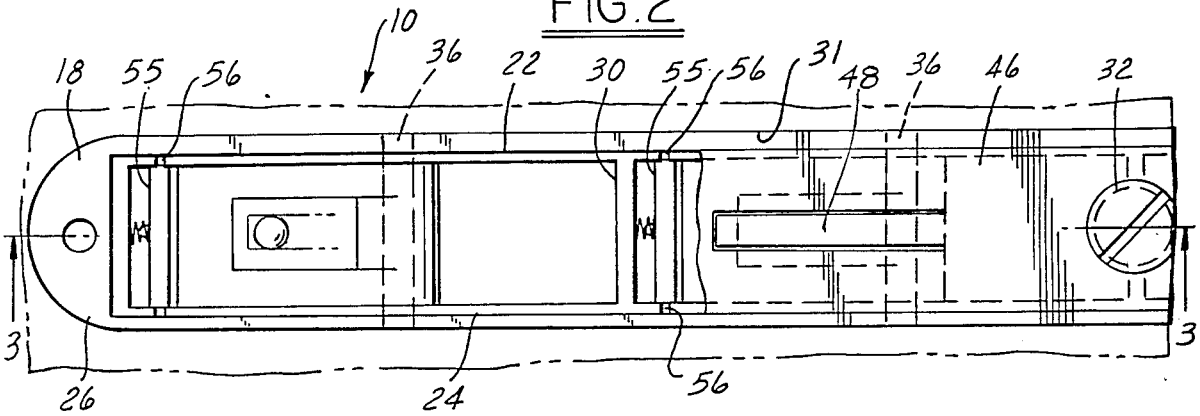
FIG. 2 is a fragmentary elevational view taken on the line 2—2 in FIG. 1.

Referring now more particularly to the drawing, there is shown a ski 10 with a binding 12 securing a ski boot 14 to the top surface of the ski in the usual position about mid-way in the length thereof and having two of the braking devices 14 and 16 of my invention installed in recesses in the bottom surface of the ski. The two braking devices 14, 16 are identical and, therefore, a description of one will be sufficient.

Each braking device comprises an elongated frame 18 having a bottom wall 20, side walls 22 and 24, end walls 26 (only one of which is shown), and an open top. The space within the frame is divided into chambers 28 by transverse upright partitions 30 spaced apart along the length of the frame. Each frame extends lengthwise of the ski and is secured within a similarly shaped recess 31 in the bottom of the ski by fasteners 32. One braking device 14 is shown immediately to the rear of the ski boot and the other braking device 16 immediately forwardly of the ski binding. It is desirable that the braking devices be located close the the ski binding where the weight of the skier is concentrated. Actually only a single braking device could be employed preferably directly beneath the ski binding. Obviously, a third braking device could be provided between the two braking devices 14 and 16 or the brake devices 14 and 16 could be replaced by a single braking device extending from the position of the braking device 14 continuously under the ski binding to the position of the braking device 16. When the braking device is installed in its recess in the bottom of the ski the bottom surface of the bottom wall 20 of the frame is flush with the bottom surface of the ski.

There is a cleat 34 mounted in each chamber 28 of the frame 18. These cleats are spaced apart lengthwise of the frame. The front end of each cleat is pivoted on a horizontal pin 36 which extends at right angles of the longitudinal center line of the frame and is fixed in the side walls of the frame. The cleats are capable of moving vertically from the operative position at the left in FIG. 3 to the raised or retracted position shown at the right in FIG. 3. Each cleat projects through an opening 38 in the bottom wall of the frame. In the raised or retracted position of the cleat, its bottom surface 40 may be substantially or approximately flush with the bottom surface of the frame but preferably extends at a very small angle from its pivot rearwardly to a point below the bottom surface of the frame. In its lower or operative position, the cleat projects significantly below the bottom surface of the frame as shown at the left in FIG. 3.

Each cleat has a projection or tooth 42 at the rear end of its bottom surface. The edge of tooth 42 is notched or serrated as shown at 43. A similar projection 44 is provided at the rear end of the upper surface. These projections 42 and 44 limit the vertical movement of the cleats beyond the upper and lower positions shown in FIG. 3.

The open top of each frame is closed by a strip 46 of spring material. The strip has a cut-out portion 48 over each chamber which is bent downward into spring pressure contact with a projection 50 on the cleat to at all times urge the cleat downwardly to the lower operative position at the left in FIG. 3. The projection 44 of each cleat substantially contacts the strip 46 in its raised or retracted position.

The openings 38 closely surround the cleats on all four sides to restrict, if not altogether prevent, the entrance of snow into the frame through the openings. The rear wall 52 of each cleat is curved on a radius centered on the axis of pin 36. The rear wall of each opening 38 is cut back along the bottom to form a ledge providing a snow stripper 51 which is in continuous contact with the curved surface 52 of the cleat throughout the full range of its movement to wipe away snow and keep it from packing into and clogging the cleat chamber. The cut back also forms a pocket 53 beneath the snow stripper 51 in which snow is allowed to collect when the cleat is pivoted to its retracted position without being forced past snow stripper 51 by tooth 42. The tooth 42 limits upward movement of the cleat by contact with the rear wall of opening 38.

A cleat wiper 55, made of a material such as nylon, is provided for each cleat. Each cleat wiper is located in a cleat chamber at the rear of the cleat and is pivoted at the top on a horizontal pivot 56 which extends at right angles to the longitudinal centerline of the frame and is fixed to the side walls of the frame. The bottom or foot 58 of the cleat wiper has a sharp transverse edge 60 which contacts the curved surface of the cleat just above snow stripper 51 to wipe away any accumulated snow and prevent it from entering the chamber. A coil spring 62 compressed between the rear wall of the chamber and the wiper and centered on a projection 63 on the wiper presses the wiper into contact with the cleat. The foot 58 of the wiper extends into a recess in the bottom wall of the chamber providing a vertical abutment 64 at the rear of the heel of the foot 58 to restrict movement of the foot away from the cleat.

Figure 3:
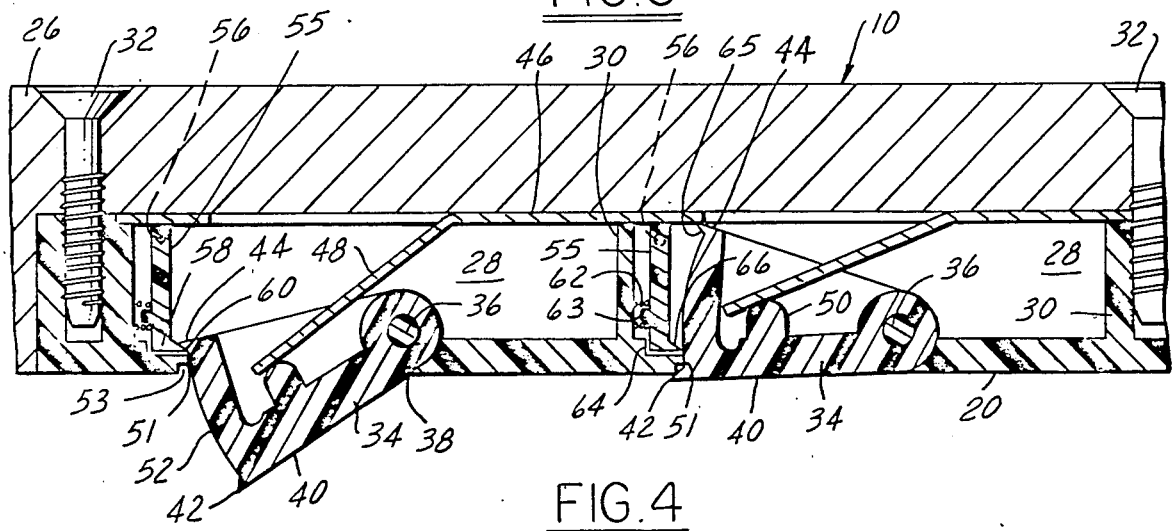
FIG. 3 is a sectional view taken on the line 3—3 in FIG. 2.
Figure 4:
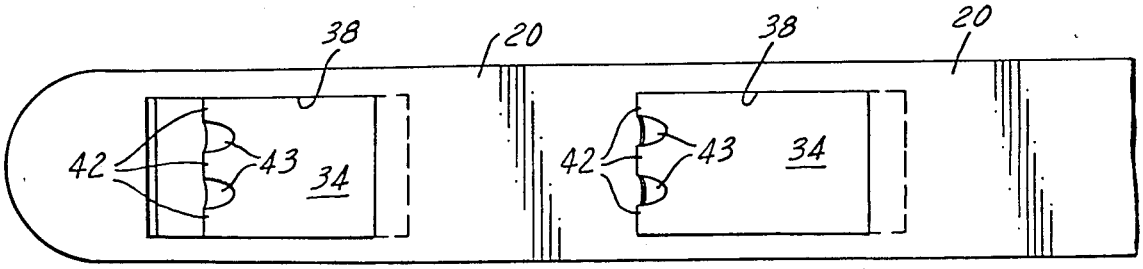
FIG. 4 is a bottom plan view of the portion of the braking device shown in FIG. 3.

The cleats are prevented from moving downward beyond the lower position of FIG. 3 by contact of the slanted surface 65 of projection 44 with the slanted surface 66 of the foot 58 of each cleat. These surfaces 65 and 66 are slanted so as to have flush engagement with each other.

In use, and when skiing down hill, the cleats will be disposed in the position shown at the right in FIG. 3 by the pressure of snow against the cleats acting in opposition to the springs 48. However, upon rearward movement of the skis, teeth 42 will dig into the snow and pivot to the position shown at the left in FIG. 3 to reduce or retard further rearward movement. The springs 48 press the cleats to the lower operative position and the tendency of the ski to move rearwardly also turns the cleats to the lower position. As previously stated, the rear ends of the cleats in their upper retracted positions project slightly below the bottom surface of the frame (which is in the plane of the bottom surface of the ski), so that the teeth 42 will immediately dig in to the snow upon initial rearward movement of the ski.

The braking device of this invention also provides better hill climbing ability. It is particularly useful for the beginning skier. For faster forward progress, the bottoms of the cleats may be flush with the ski bottoms.

I claim:

1. A braking device for reducing or retarding rearward movement of a ski, such as when climbing a hill, comprising an elongated frame adapted to be mounted lengthwise in a recess in the bottom of a ski with its bottom surface flush with the bottom surface of the ski, a plurality of cleats spaced apart lengthwise of said frame and projecting through openings in the bottom surface of said frame, means pivoting the front ends of said cleats to said frame for vertical movement of said cleats about horizontal axes extending at right angles to the longitudinal center line of the ski between a lower operative position projecting below the bottom of said frame and an upper retracted position, spring means urging said cleats to their operative positions, said cleats having teeth on the rear ends adapted to dig into snow when climbing a hill and said cleats are in their operative positions, means for preventing movement of said cleats beyond their operative and retracted positions, said openings closely receiving the sides and ends of said cleats to restrict the entrance of snow into said frame through said openings, the rear ends of said cleats being curved on a radius centered on their axes of vertical movement so as to remain in close contact with the rear walls of said openings throughout their vertical movement, the rear wall of each opening having a ledge providing a snow stripper which is in continuous contact with the curved rear end of the associated cleat through the full range of its movement to wipe away snow and keep it from packing into and clogging the cleat chamber, the rear wall of each opening having a pocket beneath the snow stripper in which snow is allowed to collect when the cleat is pivoted to its retracted position without being forced past said snow stripper, and a cleat wiper for each cleat, said cleat wiper being located in a cleat chamber at the rear of the cleat and pivoted at the top, the foot of said cleat wiper having an edge which contacts the curved rear end of the cleat just above said snow stripper to wipe away any snow that may have accumulated thereon.

2. A braking device as defined in claim 1, wherein said foot extends into a recess in the bottom wall of the chamber, said recess providing an abutment at the rear of the foot to restrict movement of the foot away from the cleat, and spring means urging said cleat wiper in a direction causing the edge of its foot to remain in continuous contact with the curved rear end of the cleat.

3. A braking device for reducing or retarding rearward movement of a ski, such as when climbing a hill, comprising an elongated frame adapted to be mounted lengthwise in a recess in the bottom of a ski with its bottom surface flush with the bottom surface of the ski, a plurality of cleats spaced apart lengthwise of said frame and projecting through openings in the bottom surface of said frame, means pivoting the front ends of said cleats to said frame for vertical movement of said cleats about horizontal axes extending at right angles to the longitudinal center line of the ski between a lower operative position projecting below the bottom of said frame and an upper retracted position, spring means urging said cleats to their operative positions, said cleats having teeth on the rear ends adapted to dig into snow when climbing a hill and said cleats are in their operative positions, means for preventing movement of said cleats beyond their operative and retracted positions, said openings closely receiving said cleats to restrict the entrance of snow into said frame through said openings, a cleat wiper for each cleat, said cleat wipers being movably mounted on said frame at the rear of the respective cleats, and spring means urging said cleat wipers into contact with the rear ends of said cleats to wipe away any snow that may have accumulated thereon.

* * * * *